United States Patent [19]

Fulmer et al.

[11] Patent Number: 4,462,511

[45] Date of Patent: Jul. 31, 1984

[54] DISSOLVING AND DISPENSING APPARATUS

[75] Inventors: Frederick J. Fulmer, Lehighton; George Moschak, Palmerton, both of Pa.

[73] Assignee: Viking Injector Company, Lehighton, Pa.

[21] Appl. No.: 534,942

[22] Filed: Sep. 21, 1983

Related U.S. Application Data

[63] Continuation of Ser. No. 187,432, Sep. 15, 1980, abandoned.

[51] Int. Cl.[3] ..... B67D 5/32

[52] U.S. Cl. ..... 222/52; 222/144; 222/133; 222/165; 222/630; 134/93; 137/268; 422/261

[58] Field of Search ..... 222/52, 129.2, 133, 222/144, 145, 164–165, 167, 630, 637; 134/100, 101, 93; 422/261, 263, 264, 266; 137/268

[56] References Cited

U.S. PATENT DOCUMENTS

| | | | |
|---|---|---|---|
| 2,520,003 | 8/1950 | Gilmore | 222/165 X |
| 3,127,067 | 3/1964 | Hall et al. | 222/165 X |
| 3,595,438 | 7/1971 | Daley | 222/67 |
| 4,020,865 | 5/1977 | Moffat et al. | 222/67 X |
| 4,063,663 | 12/1977 | Larson et al. | 222/67 X |

*Primary Examiner*—Charles A. Marmor

*Attorney, Agent, or Firm*—Berman, Aisenberg & Platt

[57] ABSTRACT

A funnel shaped conveyor receives containers of powdered materials and is coupled to the containers. A screen support member within the funnel receives granules from the container and supports the same above a spray nozzle. The nozzle directs a spray of liquid, such as water, against the underside of the support screen and wets the granules resting thereon, dissolving the same and causing the solution to pass through the screen. The nozzle further sprays the sides of the funnel in order to remove any caking material and reduce clogging. A discharge port provides the resulting solution to a receptacle, such as a washing machine. The apparatus includes a dual safety feature, which assures that an operator will not be exposed to any caustic solutions during a change of containers. Rotatable mounting brackets permit gravity fed operation in a first position, and permit container replacement in a second position in which a sensing switch disables the nozzle. Further, the nozzle remains pointed upward even in the second position, assuring that any accidental discharge is directed at the discharge port and not at the operator.

35 Claims, 10 Drawing Figures

DISSOLVING AND DISPENSING APPARATUS

This application is a continuation of Ser. No. 187,432 filed Sept. 15, 1980 now abandoned.

BACKGROUND OF THE INVENTION

1. Field of the Invention

The present invention relates to dispensing systems, and more particularly to dispensers for caustic materials including dissolving means therein and safety provisions therefor.

2. Description of the Prior Art

In commercial applications of washing machines, for example, it is desirable to reduce the cost of detergent and of maintenance time by repeated utilization of a detergent solution until its replacement. During such repeated use, it is occasionally necessary to replenish the solution with an appropriate solution of mixed detergent in order to compensate for drained solution, absorption of grease, oils, solvents, foods and other chemicals.

Early dispensers of the prior art were primarily divided into two classifications. A first class utilized a reservoir of pre-dissolved powdered materials, which, when activated, overflowed concentrated solution into the wash tank. Such systems, however, required an entire package of chemicals to be wetted, thereby releasing some of the active ingredients into the air, or providing for release at uneven rates into the tank. Typical chemicals dispensed by such systems include chlorine, surfactants, light phosphates, and oil surfaced powders.

In such prior art devices, a reservoir was fed by hand, using a scoop to transfer powdered materials from a larger container or from a package which was torn open at the reservoir. For caustic, irritant, or acidic chemicals, however, such replenishment methods provide a hazard of dangerous contact by the operator with the chemical.

A second class of dispensers relates to feeding of dry chemical from a drum by forcing water into the drum, thereby pressurizing a solution outwardly therefrom. Since this system involved the use of pressure and a dependence on the solid connection at the drum, safety of the connection was critical and could not be assured. Moreover, the chemical utilized in the apparatus was wetted prior to its use, thus providing dissipation problems similar to those associated with the above described reservoirs.

Various dispensing devices of the prior art are shown in the following U.S. patents:

Clauson U.S. Pat. No. 1,704,913; Ash U.S. Pat. No. 2,038,260; Forsyth Jr. U.S. Pat. No. 2,062,704; and Lane U.S. Pat. No. Reissue 20,262.

Gatchet U.S. Pat. No. 2,601,672 illustrates dissolution and dispensing of a dry fertilizer, while Klumb U.S. Pat. No. 2,573,576 and Fletcher et al U.S. Pat. No. 2,624,119 disclose further mixing devices.

Dispensers for powdered soap are disclosed in Hall U.S. Pat. No. 874,072; Bohlig U.S. Pat. No. 1,041,417; and Gilmore U.S. Pat. No. 2,520,003.

Harper U.S. Pat. No. 1,653,627 discloses a drinking glass washer, while McDougall U.S. Pat. No. 3,072,137 and Holmes U.S. Pat. No. 3,166,086 provide fluid mixing devices.

None of the above cited art references, however, provide for safety features to avoid the contact between an operator and caustic materials which might be used therein. Such devices, a fortiori, do not provide for duplicated safety systems to assure, in a fail-safe manner, that an operator will not be exposed to such materials. Further, the prior art devices above described do not provide apparatus for maintaining dry chemicals from being prematurely wetted, nor for assuring that an operator need not come in contact with such chemicals during a changeover or replenishment cycle.

In a more recent device of the prior art, however, as disclosed in U.S. Pat. No. 4,063,663 to Larson et al., a dispenser apparatus is provided which includes a curved screen member for retainably supporting a powdered detergent thereabove and which includes a nozzle below the screen. The detergent container forms a part of the dispensing apparatus and includes a door at its top for manual replenishment of the detergent. A safety feature, in the form of a mercury switch, is triggered by opening of the door to disable the nozzle and thus to minimize the possibility of the operator being sprayed by the caustic materials involved. However, in the event that the switch should fail when the operator opens the access door, a hot, caustic solution could easily splash into the operator's face. Moreover, an operator is required to load the caustic materials manually through the access door, and thus must come in contact with the potentially hazardous chemicals. Still further, the access door must be opened in order to determine whether the detergent needs to be replaced or replenished.

The screen in the prior art device presents the potential, under varying water pressure conditions, that free flow of solution may not be permitted, and that, therefore, the chemical might be overwetted or, in situations of low pressure, may not be dissolved. Such uneven results may require increased operator attention and intervention in the operation of the device, thus increasing its cost of operation and furthering the potential of hazardous contact with the chemical utilized therein.

SUMMARY AND OBJECTS OF THE INVENTION

It is accordingly an object of the present invention to overcome the deficiencies of the prior art and to provide an apparatus for dissolving and dispensing chemicals, including fail-safe protection systems for an operator.

It is a further object of the invention to provide for a dispenser, the bracket including a water passageway therein.

Still a further object of the invention is the utilization of a screen for receiving and supporting detergent provided from a container.

Another object of the invention is the provision of a dissolving and dispensing system wherein an operator need not come in contact with the chemicals utilized therein, by providing a coupling means for accepting a standardized shipping container for such chemicals.

It is a further object of the invention to provide a safety switch responsive to the proper positioning of the dispensing apparatus in its dispensing position to activate a nozzle and an alignment for said switch to insure positive activation.

Yet another object of the invention is the provision of a nozzle within a rotatable dispensing apparatus, the nozzle fixedly pointed towards an input opening in the dispenser when in its normal dispensing position, and pointed towards a discharge port of the dispenser when in its inverted, container replacement position.

In accordance with the foregoing objects, the present invention provides a dissolving and dispensing apparatus for powdered detergent including a funnel means having a coupling means attached to its wide opening for coupling to a container of powdered detergent, and preferably to a standardized shipping container thereof. A screen is provided within the funnel means to receive thereon powdered granules from said container. A nozzle is disposed below the screen for directing a spray at the screen, thus wetting and dissolving the powdered granules immediately in contact therewith. The nozzle further directs a spray at the funnel wall below the screen, in order further to agitate the chemicals and to force the dissolved chemicals towards the side of the funnel. A narrow discharge port is provided at the other end of the funnel for discharging the dissolved detergent therefrom to a receiving tank in a washing machine, for example.

The apparatus includes a pivotable, rotating dispensing apparatus having a wall support for mounting on a wall adjacent the washing machine or on a surface of the washing machine, and a second portion forming part of the funnel portion. A stop is provided in the wall support to assure that rotation from the normal dispensing position to the container replacement position may be had in only one direction, and that the reverse rotation may be had only in the opposite direction, thus avoiding the possibility of twisting and kinking of the discharge tube. The stop further helps hold the apparatus in its dispensing position. A detent means is provided for insuring the proper orientation of the wall support and funnel portion, and a microswitch is provided to disable the flow of water to the nozzle when the apparatus is rotated for changing of containers. The detent means and the switch means may cooperate with one another.

A locking means is provided to assure that the spray arm and nozzle combination remain pointed upwardly even when the apparatus is rotated to its container changing position. Thus, even if the switch were to fail during the changing of containers, any discharge of solution through the intake opening, now located below the nozzle, would merely be gravity fed leakage of solution not entering the discharge tube, as opposed to pressurized discharge from the nozzle.

Further, a vent hole is provided at the funnel portion directed at such an angle as to provide relief of high pressure build up while not leaking fluids during normal operation. Such a vent hole provides an air intake point, thus allowing for a smooth gravity feed of fluids to the receiving tank.

BRIEF DESCRIPTION OF THE DRAWING

The foregoing and other objects, features and advantages of the present invention will become more readily apparent from the following specification and appended claims when considered in conjunction with the drawing in which:

DETAILED DESCRIPTION OF THE PREFERRED EMBODIMENT

Figure 1:
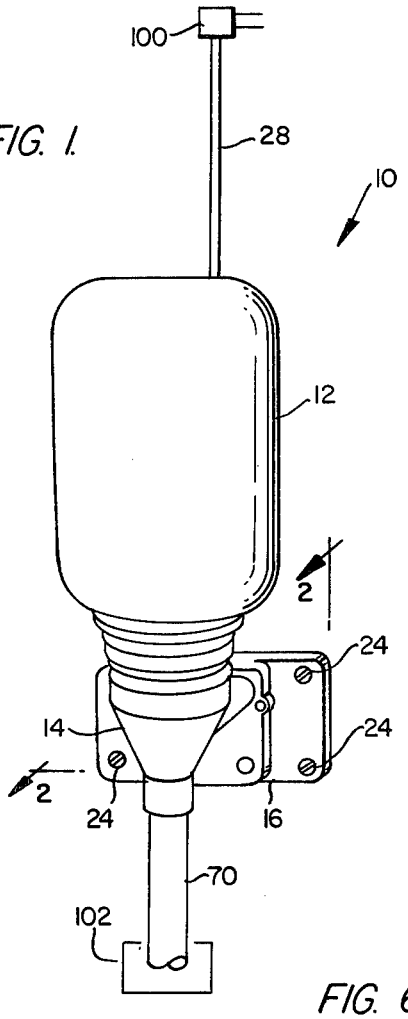
FIG. 1 is a perspective view of the invention mounted for dispensing powered materials stored therein.

Referring to FIG. 1, the present dissolving and dispensing apparatus is generally shown at 10. The apparatus includes a container 12, which is preferably a standardized shipping container, having a threaded opening, and a funnel conveying means 14, hereafter funnel means. The threaded opening may be internally or externally threaded, or both.

Figure 3:
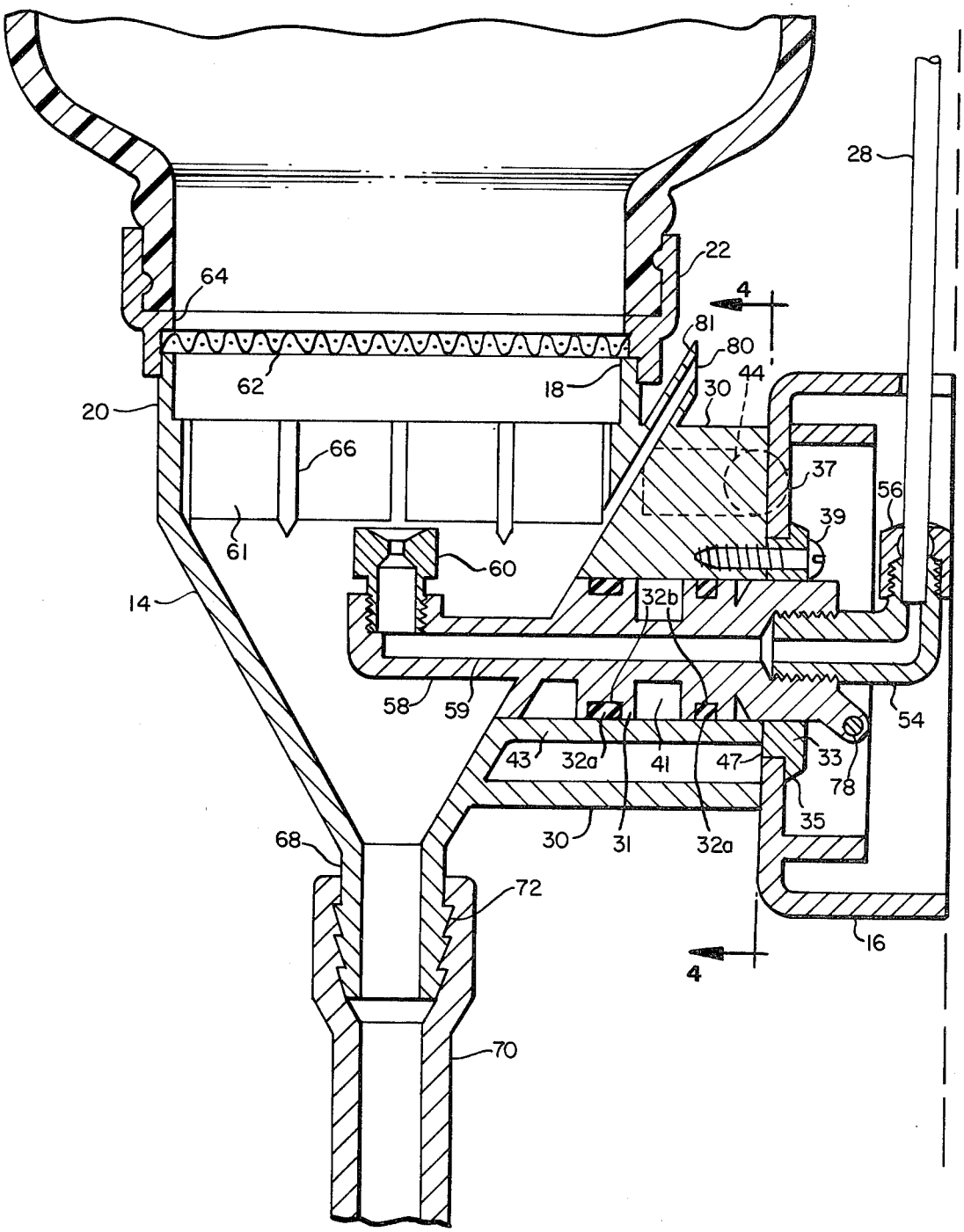
FIG. 3 is a sectional view of the dispensing apparatus and mounting brackets taken along section lines 3—3 in FIG. 2.

The funnel means 14 is rotatably mounted to a support mount 16 which is, in turn, fixedly mounted to a vertical support such as a vertical wall adjacent the washing machine, or to a wall of the washing machine itself. As is best seen in FIG. 3, for example, funnel means 14 is generally funnel shaped and includes a wide opening shown at 18. The opening 18 is shown as part of a substantially cylindrical portion 20. A coupling means 22 is fixed to the funnel means 14. While the present embodiment shows the coupling means 22 as being affixed to the intake opening of the funnel, it is appreciated that the container might be coupled to the funnel other than at the opening. That is, a bracket may be provided for coupling the container to the funnel, and the openings may be otherwise connected. Further, while the presently preferred coupling between the container and the funnel is shown as a threaded coupling, the container being externally threaded and the coupling portion of the funnel internally threaded, it is appreciated that, as previously described, the container might be internally threaded, and that the coupling means be externally threaded. Further, other coupling means might be provided, including but not limited to bayonet sleeves and the like.

It is presently contemplated that an advantage of the invention is attained by the use of standardized shipping containers, which, for example, may be 100 mm containers, and which may be quickly and simply coupled with the funnel means 14 without requiring any operator intervention to scoop out or otherwise contact the powder. The containers are preferably formed of a plastic or other material which is at least somewhat translucent. That is, the material of the container is at least sufficiently translucent to permit external observation of the level of the powder remaining therein so that an operator may quickly determine the need for replacement of containers without disturbing the operation of the system. Of course, glass or other transparent materials might be used for the container to provide more accurate observation of the remaining materials.

Further, the present disclosure contemplates the use of containers having granular detergent material therein. It is possible, however, that the material may be provided in solid form, with a granulating component provided in the apparatus for converting the solid (or other material) to a powder for use as herein contemplated.

Figure 2:
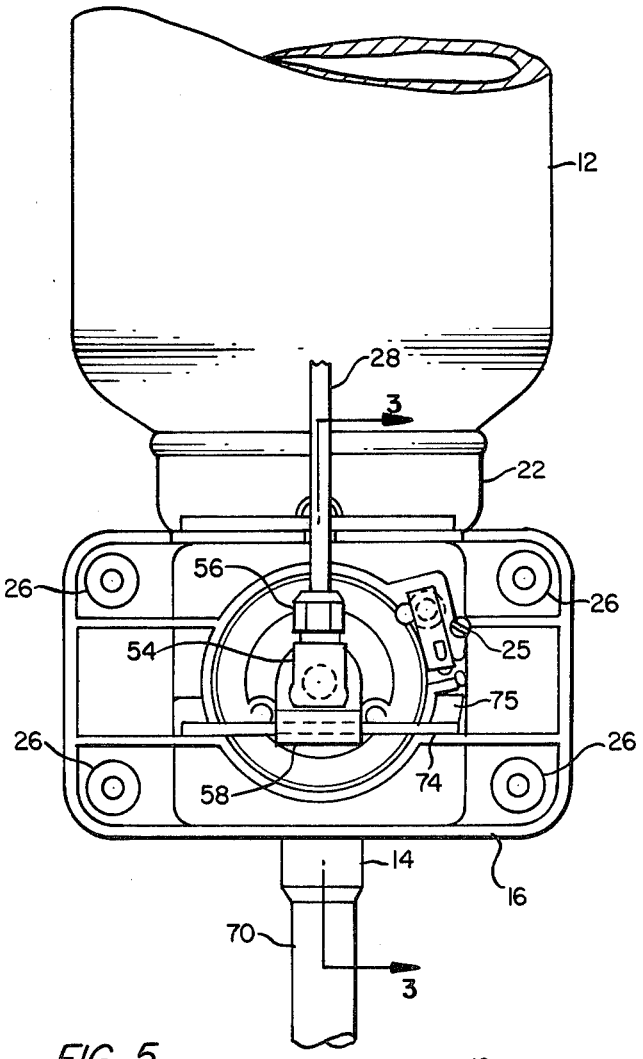
FIG. 2 is a view of the apparatus of the invention from behind the surface mounting brackets as shown by section lines 2—2 in FIG. 1.
Figure 5:
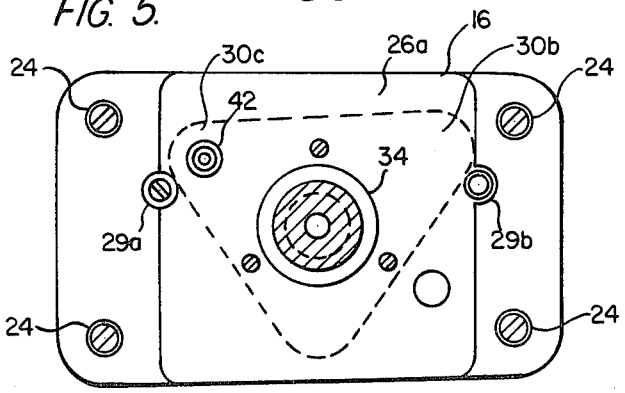
FIG. 5 is a view of the portion of the surface mounting bracket attached to a fixed surface.
Figure 4:
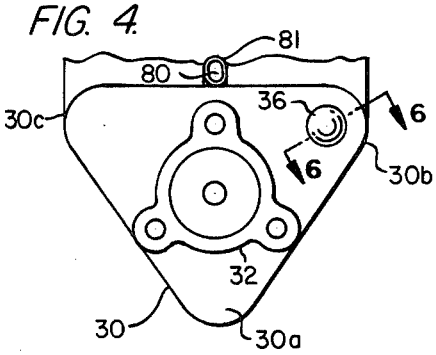
FIG. 4 is a view of a portion of the surface mounting bracket attached to the conveying funnel, taken along section lines 4—4 in FIG. 3.

The support mount 16 may be fixed to the vertical surface by means of attaching devices, shown in FIGS. 1 and 5 as screws 24. Four holes 26 are provided for the screws, as shown in FIG. 2.

A water supply line 28 provides water to the apparatus for dissolving granules of the material. A vacuum protecting device (not shown) may be provided on water supply line 28 to prevent the occurrence of siphoning.

A rotating portion 30 is attached to the funnel means 14.

Support mount 16 includes an indentation 36 and a housing 38 for a microswitch 40. The rotation portion 30 includes a housing 42 for a ball 44, and a biasing spring 46. Ball 44 thus provides a detent means 45 with indentation 36 of the housing 38 formed in support bracket 16. With the funnel means 14 properly positioned so that container 12 is inverted and substantially vertical, ball 44 snaps into indentation 36 activating microswitch 40 which in turn signals the valve to supply liquid to the apparatus and provides proper positioning for the apparatus in its supply position. In an alternative embodiment, ball 44 depresses a pin or button actively connected to microswitch 40. Additionally, ball 44 is used to depress switching arm 48, thereby completing a circuit between wires 50 and 52 connected to microswitch 40. It is appreciated that a single wire may suffice for this purpose, and that the body of the microswitch 40 may be grounded to the support mount 16 by mechanical contact therewith. The wires 50 and 52 (or one wire and ground) form one of the supply paths from a power supply to a conventional solenoid used in a control valve 100 for water in supply line 28. Thus, only when the apparatus is in an appropriately chosen (substantially vertical) position, is the solenoid 100 activated and the valve opened to permit water to pass through line 28. While other fluids may be used in the invention to dissolve the powdered materials, the preferred embodiment utilizes water, preferably hot water, for that purpose. Such a water supply is typically available in a washing environment and is easily provided to the present apparatus, either as a separate supply or as a part of the rinsing system of the machine.

As seen in FIG. 3, rotating portion 30 rotates about a centrally located spindle 31 secured to support mount 16 (as seen in FIG. 2) through opening 47 containing a passage 59 which transmits water through spray arm 58 to nozzle 60. Arm 43 is connected to funnel means 14 and rotates about stationary spindle 31. Spindle 31 has hollow portions 41 which reduce surface-to-surface contact and resulting friction between spindle 31 and arm 43. Collar 33 is connected for rotation with respect to spindle 31 and has a lip 35 which overlies plate 37 of support mount 16 to allow for rotation of funnel means 14 for loading container 12. Lip 35 maintains collar 33 locked onto support mount 16 by attachment means 39, i.e., a screw as shown.

Sealing rings **32*a* are contained in annular recess 32*b* circumferentially arrayed about spindle 31. Sealing rings 41*a* seal spindle 31 to rotating portion 30 to prevent any leakage of liquid from around the spindle. Sealing rings 41*a* preferably have a figure eight cross section to provide two sealing surfaces on each O-ring surface to sealingly engage inner cylindrical surface 61 of rotating portion 30 and prevent leakage of liquid past spindle 31**.

Upon rotation of the apparatus from the vertical dispensing position, the ball 44 is rotated out of indentation 36 so as no longer to depress switching arm 48, thus opening switch 40 and thereby deactivating the solenoid and closing the valve to shut off the supply of water in line 28. Alternatively, switch 40 may be in the rotating portion 30 and the ball and biasing spring mechanism may be in the fixed portion in support mount 16. Moreover, the microswitch actuating mechanism need not be the same as the detent means 45. That is, a separate indentation and ball, with biasing spring having a stiff spring constant, may be used to provide the positioning detent, while a smaller actuating projection, for example, spring loaded by a softer spring, may be used to operate microswitch 40.

Stop **29*a* is provided on the front face 16*a* of support mount 16 offset above and to the side of the center of rotation of rotating portion 30 to allow clockwise rotation of the dispenser and chemical container. Stop 29*a* is secured to support mount 16 by securement means such as screws 25. Lobe 30*a* is of a shorter radial dimension 34 than lobes 30*b* and 30*c* to allow it to rotate past stops 29. Stop 29*a* is a reversible cylinder placed above the center of rotation of rotating portion 30 so as to not interfere with the rotation of lobe 30*a* of rotating portion 30. Stop 29*a* is seen in FIG. 5 as sitting to the upper left of the center of rotation of rotating portion 30. Lobe 30*c* is stopped by and rests against stop 29*a* in its dispensing position. In dispensing position, lobe 30*c* rests adjacent stop 29*a* and ball 44 is centered over the microswitch 40 to actuate the water valve to initiate water flow into the dispenser. Rotating portion 30 can be rotated clockwise about its center of rotation until lobe 30*c* abutts against stop 29*a* and the powder container is in its replenishment position. The presence of stop 29*a* also helps retain the dispenser in its upright dispensing position resting against stop 29*a*. Stop 29*a* also prevents complete rotation of rotating portion 30 as lobe 30*b* abutts against the opposite side of stop 29*a*. Stop 29*a* can be removed and stop 29*b*** added in a position above and to the right of the center of rotation to allow the dispenser to rotate counterclockwise.

Line 28 is shown in FIG. 2 as being coupled to a terminal 54 by nut 56. Terminal 54 provides a connection to water spray arm 58 as shown in FIG. 3, for example. Spray arm 58 terminates in a nozzle 60 which may threadedly engage the arm and spray water, under pressure, in a generally conical distribution. A screen 62 is provided within the funnel means 14 as shown in FIG. 3. The screen is substantially located at the interface between container 12 and funnel means 14. The screen 62 may be retained in place by any of conventionally known means. As shown in FIG. 3, the present embodiment provides a flange 64 on the coupling means 22 for retaining the screen 62 in cooperation with the upper surface of cylindrical portion 20 of the funnel means 14. Coupling means 22 may be pressed onto cylindrical portion 20, may be bonded or welded thereto, or may be otherwise affixed to funnel means 14. It is possible, of course, that the screen may be retained within a circular notch along the periphery of cylindrical portion 20. In one embodiment of the invention, the screen 62 is flat, thus providing for direct gravity feed of powdered materials which pass perpendicularly through the openings of the screen. In another embodiment, the screen is an inverted cone which allows more perpendicular contact of the spray with the screen.

When water is supplied under pressure to nozzle 60, a spray is directed in a broad cone shaped spray at screen 62 as well as at the sidewalls 21 of cylindrical portion 20. Part of the spray penetrates the screen and wets the granules of material immediately in contact therewith, leaving unwetted the ramaining powdered granules. The remaining spray impacts the side walls of cylinder portion 20. The granules are partially dissolved and form a solution which is gravity fed through the openings of screen 62 to the body of funnel means 14. The openings of the screen are chosen to be sufficiently small so as not to permit passage of the granulated material therethrough, yet to allow the spray mist to penetrate the screen to dissolve the powder. In one embodiment, the flat, substantially horizontal positioning of a screen provides holes therein that are substantially vertically oriented and permit for direct passage of the solution of powder therethrough, thus minimizing the formation of a slurry and the clogging of the pores of screen 62 which may occur in portions of a non-horizontally aligned screen. The wetted powder and partial powder-water solution fall from screen 62 and are further mixed with water of the spray impacting the side walls 21 of cylinder portion 20. This addition of water more completely dissolves the powder in cylinder portion 20. Further, the sidewalls of cylindrical portion 20 are provided with the vertical ribs 66 to provide a direction of flow, support and revolution of spray hitting the wall 21 and direct downwardly the flow of any material which may come in contact therewith. The dual action of water spray impacting both the screen 62 and the side walls 21 allows for complete mixing of the powder in water prior to exit from discharge opening 68. The more complete two stage mixing allows screen 62 to be placed closer to nozzle 60. The cone of spray impacts partially dissolved powder and wets granules on screen 62 to provide for a steady feed without the use of mechanical mixers to provide a steady supply of powder.

In an alternative embodiment, screen 62 is shaped as an inverted cone with the wide opening facing nozzle 60.

Figure 7:
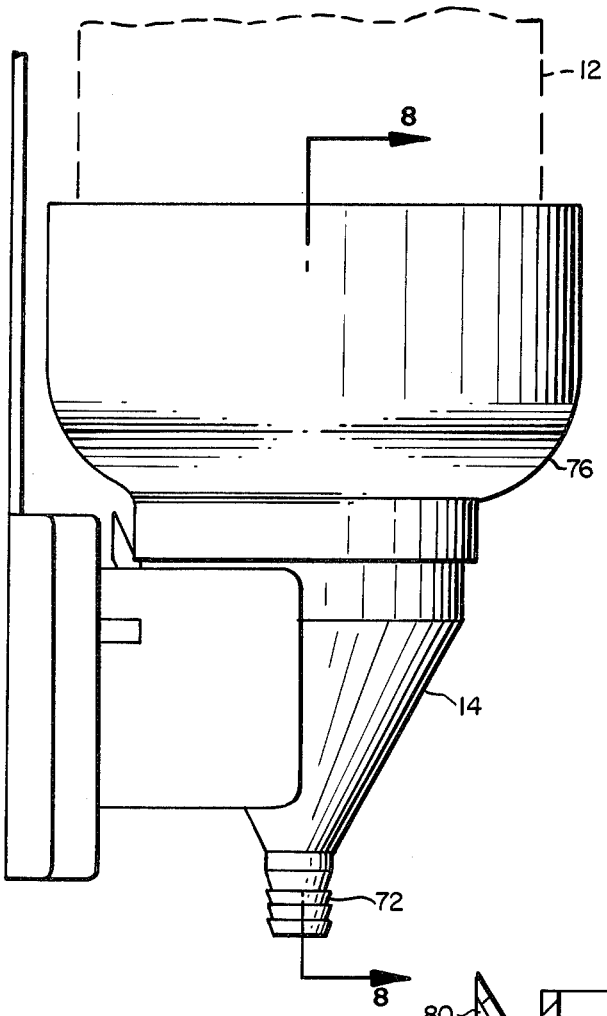
FIG. 7 is a view of the invention in combination with a protective shroud provided therefor.
Figure 8:
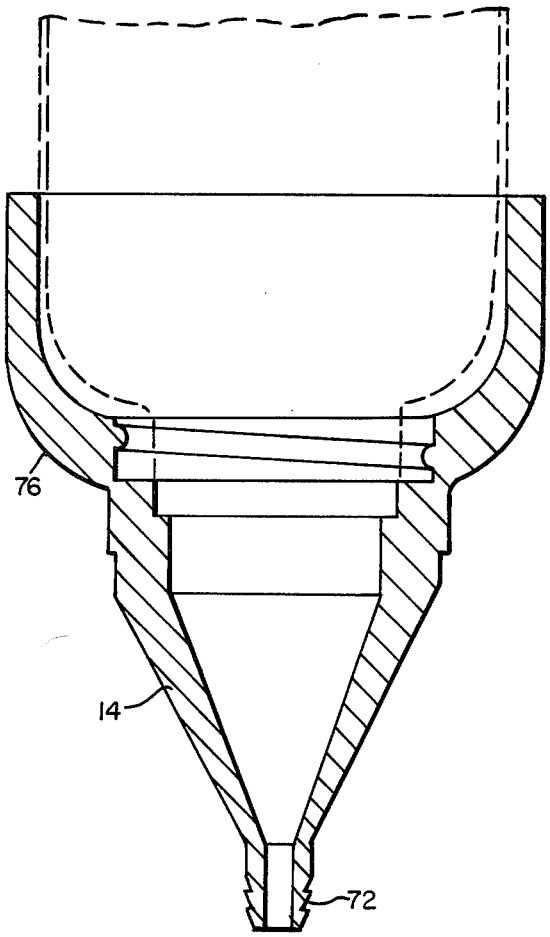
FIG. 8 is a sectional view taken along lines 8—8 in FIG. 7.

The nozzle 60 is selected to provide appropriate amounts of liquid to mix with the powder in container 12 to yield a resulting solution having a desired concentration. The concentrated solution produced by the apparatus is gravity fed to an exit, or discharge opening 68. As seen in FIGS. 3, 7 and 8, the exterior of discharge opening 68 is ribbed, in order better to retain a discharge tube 70 attached thereto. Ribs 72 may provide the only retaining force on tube 70, or may be supplemented or replaced by other retaining means. One alternative or supplemental retaining means could be a clamp surrounding the receiving end of tube 70 and tightening the same around discharge opening 68.

Although the discussion herein is in terms of gravity-fed powder and gravity-fed solution, it is possible, of course, to utilize some form of force feeding in the apparatus without substantially departing from the basic advantages thereof.

Figure 10:
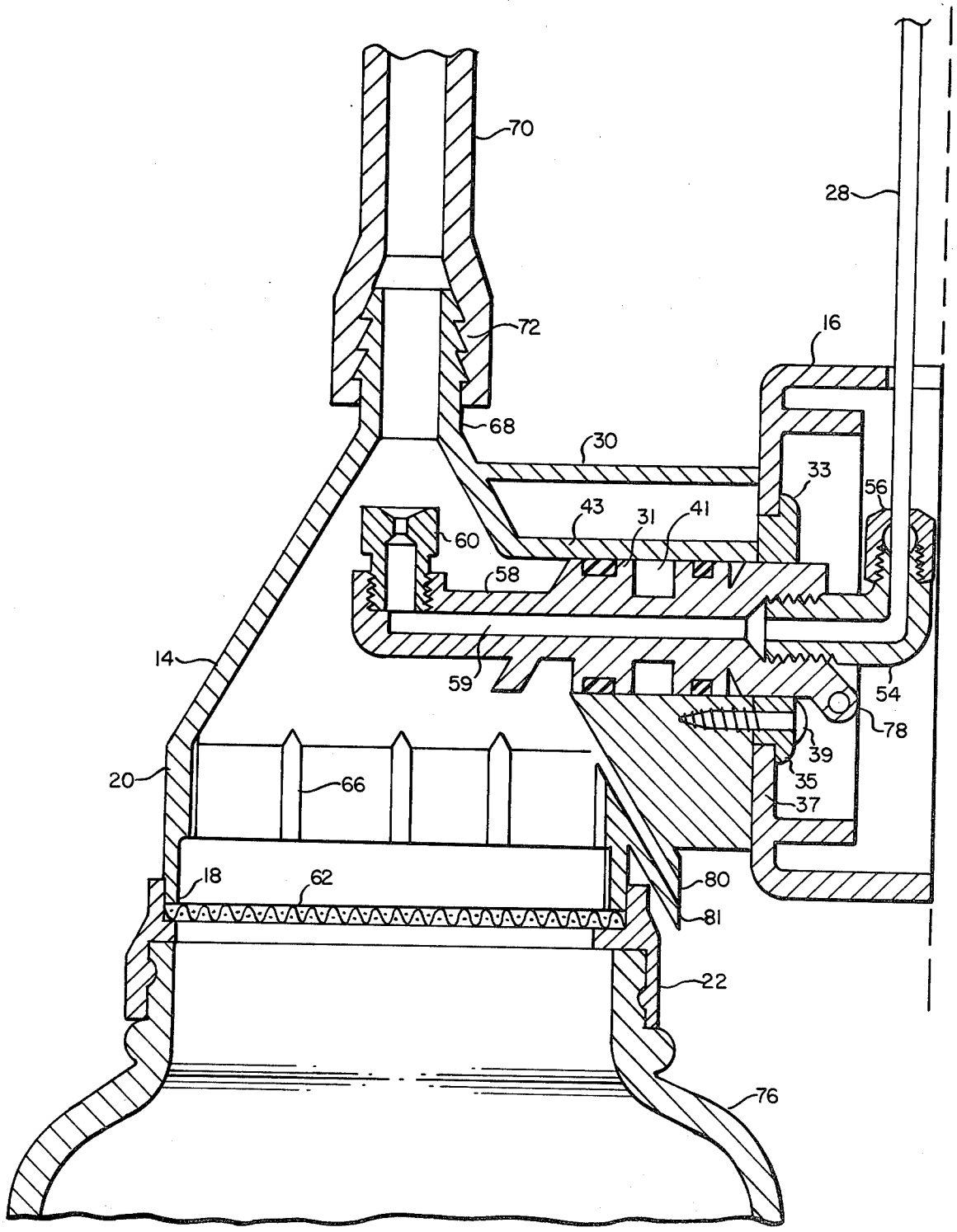
FIG. 10 is a sectional view of the invention rotated into the replenishment position

The rotation portion 30 permits replacement of the powder materials easily and without operator contact with the materials as follows. Upon detecting by external inspection that container 12 is empty, the operator rotates the entire apparatus about the axis of rings 32 and 34 by grasping funnel means 14. Such rotation by 180° results in the empty bottle being in an upright position below the funnel, with the threaded opening of the container above its cylindrical portion as seen in FIG. 10 wherein reference numerals as used in FIG. 3 indicate the same elements. In this position the empty container is threadedly separated from funnel means 14 and a new container is threaded in its place. With the use of standardized shipping containers it is seen that an operator needs only to remove a shipping cap or other seal provided for the container, and need not tear any package, open any box, nor convey by scoop or other means the caustic chemicals from one container to another. The apparatus including the new container is then rotated in the reverse direction, to avoid kinking of discharge tube 70, back to the dispensing position. Interaction of stop **29*a* prevents rotation of the apparatus in a manner to kink discharge tube 70. It is thus seen that the present invention provides a significant advantage of avoiding the possibility of spillage of or damage by the materials used therein. A further advantage is provided by the preferred embodiment wherein nozzle 60 is retained in its upward pointing position during the replenishment operation hereinabove described. A locking bar, shown at 74 and arms 75 in FIG. 2, are used to prevent the spray arm and nozzle from rotating during rotation of the apparatus. Consequently, even if switch 40 or its controlled solenoid operated valve were to fail during the replenishment operation and the nozzle were to begin spraying, any spray would be upwardly directed towards the discharge opening 68 and discharge tube 70 away from the caustic chemicals. Also the discharge would gravity feed to the screen 62 as described above. The hot materials thus would not be directed at the operator, and would instead be drained into the receiving tank 102 of the associated washing machine. This added safety factor allows other strong substances to be used. Of course, any of the pressurized spray not entering the discharge opening would be incident upon the funnel and would drop gently towards the opening 18, located below the nozzle while the apparatus is inverted and being replenished with the powdered chemicals. While the nozzle may be permitted to rotate, it is an advantage of the present invention that the spray arm and nozzle are fixed and prevented from rotation. As a further safety feature in another embodiment, a locking means (not shown) automatically engages the coupling means 22 during normal dispensing operations. A spring loaded ball engages a hole in the threaded collar and a matching hole in the threaded container opening when the container is inverted, similar to the spring biased ball 44 as previously described. Such an added safety feature would disengage only when the apparatus is rotated to the proper replenishment position, thus further assuring that a careless operator would not harm himself or herself by attempting to remove a container which might still contain its caustic contents. This feature would further assure that under no circumstance could a nozzle spray a screen and direct a pressurized discharge out through opening 18**.

Figure 9:
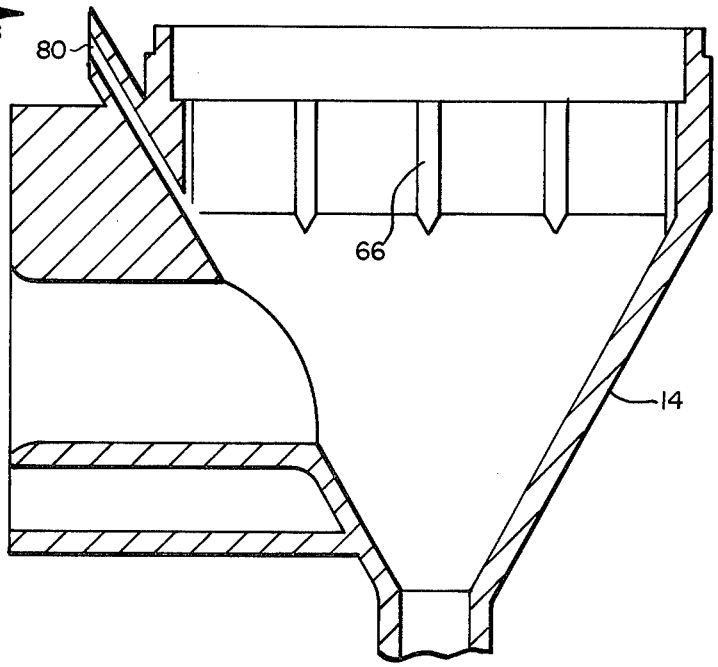
FIG. 9 is a sectional view of the conveying funnel and bracket of the invention.

As shown in FIGS. 7 and 8, the apparatus of the invention may be provided with a protective shroud 76, together with holding threads to align the container during loading and to provide protection from bumping once in the loaded position. The use of such shrouds permits the use of softer materials to form the containers since the shroud provides positive reinforcement for the outer surface of the container, and extends above the threaded area, reaching a level sufficiently high to maintain support of the container. With coupling threads provided in the shroud, the conveyor funnel may be as shown in FIG. 9, without a coupling for the container. Alternatively, a number of replaceable coupling collars may be provided for the conveyor funnel which may attached thereto to provide a coupling for different sized containers with differing threaded openings. As previously described, the coupling means may be affixed to or formed as a part of the funnel means 14 permanently.

In order to avoid kinking or twisting of the discharge tube 70 and to assure positive safety switch engagement, a pair of positioning stops may be provided. Collar 33 is provided on spindle 31 and projects through opening 47 of support mount 16. Collar 33 is secured to rotating portion 30 by fastening means 39, shown as a screw. Spindle 31 has a loop 78 projecting through opening 47 secures locking bar 74 which is held in place by arms 75 on the back of support mount 16 to prevent rotation and withdrawal of spindle 31. Locking bar 74 retains the spindle inserted through opening 47 in its position. Funnel means 14 connected to rotating portion 30 rotates about spindle 31 from a dispensing position, 180° to a position to allow the operator to change an empty container for a full one. Rotation other than in the permitted directions is prevented by interaction of the lobes of rotating portion 30 and stop 29*a*. A further stop may be provided to assure that the dispensing position cannot be 'overshot'. That is, the stop aligns the apparatus vertically and at a position wherein ball 44 depresses switching arm 48.

Figure 6:
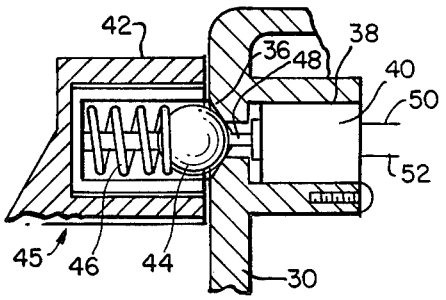
FIG. 6 is a sectional view of the conveying funnel bracket taken along section lines 6—6 in FIG. 4.

The present dissolving and dispensing apparatus may be controlled by manually or electronically operated valves, the latter operated by devices such as electronic timing means, concentration detectors or sequencing operators. Examples of various possible controls are described in U.S. Pat. No. 4,063,663, for example, with reference to FIGS. 5 and 6, and the related text, hereby incorporated by reference. When operated as an hydraulic unit, the associated washing machine should be turned off for loading. A petcock, in line from the rinse section, should be used to meter water flow and provide titration upon a new water fill.

A vent opening 80, shown in FIG. 3, may be provided in the conveying funnel 14. The opening serves three purposes: first, pressure relief is provided for the interior of the funnel during operation; secondly, the vent serves as an air intake to permit smooth gravity feeding of the solution from the funnel to the discharge tube 70; and, finally, the vent provides a safety relief opening should part of the unit become clogged. The opening is angled to assure that none of the solution will leak outwardly.

A shroud 81 covers the vent opening 80 to guide the exit of material from vent 80. The vent 80 opens to the back of the rotating portion 30 and will spray sipport mount 16 or the wall with dissolved chemicals. In a preferred embodiment, the vent 80 is nonclogging, preferably $\frac{3}{8}''$ in diameter. By forcing exiting chemicals out the back and not out the front, an individual standing in front of the apparatus will not get sprayed by the chemicals evacuated through the relief vent. The vent 80 also provides a backup to eliminate water buildup in the funnel and prevent clogging of the screen.

The preceding specification describes, by way of illustration and not of limitation, a preferred embodiment of the invention. Several equivalent variations of the described embodiment have been provided herein, and others will occur to those skilled in the art. Such modifications, variations and equivalents are within the scope of the invention as recited with greater particularity in the appended claims, when interpreted to obtain the benefits of all equivalents to which the invention is fairly entitled.

What is claimed is:

1. Material dispensing apparatus for dispensing a solution of said material comprising:

(a) a container of said material formed of a component which enables external observation of a level of said material within said container;

(b) said container having an opening;

(c) conveying means having coupling means for coupling a first opening to said conveying means to said opening of said container;

(d) receiving means attached to said conveying means for receiving granules of said materials fed from said container;

(e) dissolving means comprising a nozzle for directing a liquid at said receiving means to form a solution;

(f) said conveying means having a second opening therein for dispensing said solution; and (g) rotating means for rotating said container and said conveying means from a first position wherein granules of said material may be fed from said container to said receiving means, to a second position wherein granules of said material may not be fed from said container to said receiving means.

2. The dispensing apparatus recited in claim 1 wherein said conveying means includes a segment comprising a frustum of a cone, with its larger opening receiving said material from said opening of said container and its smaller opening directing said solution to said second opening of said conveying means.

3. The dispensing apparatus recited in claim 2 wherein said material is gravity fed from said container to said receiving means, and said solution is gravity fed from said receiving means to said second opening, said container being operatively disposed in an inverted position above said first opening in said first position of said coupled container and conveying means, and inoperatively disposed below said first opening in said second position of said coupled container and conveying means.

4. The dispensing apparatus recited in claim 3 further comprising discharge means connected to said second opening of said conveying means for discharging said solution in said first position.

5. The dispensing apparatus recited in claim 4 further comprising means for orienting said nozzle substantially upwardly toward said first opening when said coupled container and conveying means are in said first position and toward said second opening when said coupled container and conveying means are in said second position, thereby assuring that any discharge of said nozzle during replacement of said container in said second position is directed away from said first opening.

6. The dispensing apparatus recited in claim 5 wherein said conveying means includes a substantially cylindrical portion between said larger opening of said frustum of a cone and said first opening, said coupling means comprising an internally threaded portion associated with said cylindrical portion for coupling with an externally threaded portion associated with said container opening.

7. The dispensing apparatus recited in claim 6 wherein said receiving means comprises a perforated material disposed above said nozzle in said first position and clamped between a flange formed in said coupling means and said cylindrical portion.

8. The dispensing apparatus recited in claim 7 wherein said nozzle comprises means for directing a spray of fluid against said cylindrical portion as well as against said receiving means whereby more complete dissolving of said material is assured and whereby clogging is reduced.

9. An apparatus for dissolving and dispensing powdered materials from a container comprising:

(a) conveying means for said materials having coupling means at one end thereof for coupling to said container;

(b) said conveying means having a first opening at said one end for receiving said powdered materials from an opening in said container, and a second opening at a second end thereof for dispensing said powdered materials in a dissolved state;

(c) a porous support member within said conveying means for supporting said powdered materials in an undissolved state on one surface thereof;

(d) nozzle means disposed within said conveying means for directing a liquid under pressure at another surface of said support member and for wetting powdered material granules supported on one end surface of said support member;

(e) mounting means for rotatably mounting said conveying means to a fixed structure comprising:

(i) first mounting bracket for attachment to said fixed structure;

(ii) second mounting bracket for attachment to said conveying means and for rotatably engaging said first mounting bracket;

(f) said conveying means being rotatable between a first, operative position wherein said powdered materials pass from said container to said conveying means for dissolution and dispensing, and a second inoperative position wherein said powdered materials do not pass from said container to said conveying means.

10. The apparatus recited in claim 9 further comprising control means for enabling and disabling flow of said liquid to said nozzle means.

11. The apparatus recited in claim 10 wherein said support member comprises screen means having apertures sized for preventing granules of said powdered materials from passing therethrough and for permitting passage of said powdered materials in a dissolved state, and wherein said nozzle means comprises directional means for directing a spray emanating therefrom against said another surface of said screen means and against a portion of said conveying means.

12. The apparatus recited in claim 11 wherein said control means comprises means responsive to rotation of said conveying means from said first position, for disabling flow to said nozzle means, whereby an emptied container of said caustic materials may be uncoupled from said conveying means and a filled container coupled thereto, without the possibility of solution escaping from said apparatus.

13. The apparatus recited in claim 12 wherein said control means comprises a solenoid operated valve in a supply line of said liquid to said nozzle, and said means responsive comprises switching means in one of said first and second mounting brackets and actuating means for said switching means in the other of said first and second mounting brackets.

14. The apparatus recited in claim 13 wherein said switching means comprises microswitch means in said first mounting bracket and said actuating means comprises spring actuated means for switching said microswitch means and located in said second mounting bracket.

15. The apparatus recited in claim 12 further comprising safety means for directing any accidental discharge from said nozzle in said second position toward said second opening of said conveying means, and discharge means connected to said second opening for discharging any solution emanating therefrom to a receiving tank.

16. The apparatus recited in claim 15 wherein said safety means comprises means for retaining said nozzle means for pointing in a fixed direction oriented toward said first opening of said conveying means in said first position thereof, and toward said second opening of said conveying means in said second position thereof.

17. The apparatus recited in claim 9 wherein said mounting means further comprises stop means for preventing rotation of said apparatus by 360° and thereby enabling rotation from said first position to said second position only in a first direction, and rotation from said second position to said first position only in a second direction opposite to said first direction.

18. The apparatus recited in claim 17 including detent means for positioning said apparatus in said first position, said detent means further comprising means for actuating a switch means for enabling flow of liquid to said nozzle means when said apparatus is in said first position and disabling flow of liquid when out of said first position.

19. The apparatus recited in claim 9 further comprising protective means for protecting said container from damaging physical contact once coupled to said conveying means.

20. The apparatus of claim 19 wherein said protective means comprises a protective shroud containing threads to receive a container and which extends axially upward to cover said container.

21. The apparatus recited in claim 9 wherein said conveying means is substantially funnel shaped for receiving said powdered materials from a wide opening forming said first opening coupled to said container, and for dispensing said dissolved powder from a narrow opening forming said second opening, coupled to a tube means for directing said dissolved powder to a receiving tank.

22. The apparatus recited in claim 20 further comprising venting means in said conveying means comprising an opening for relieving pressure buildup, said opening oriented to prevent leakage in said first position, said venting means further providing air intake, enabling an even gravity feeding of said dissolved powder.

23. The apparatus recited in claim 21 further comprising protecting means for said container associated with said conveying means.

24. The apparatus of claim 17 wherein said stop means comprises a cylindrical projection on the face of said first mounting bracket, offset and placed above the center of rotation of said second mounting bracket, said second mounting bracket having one lobe whose length is less than the distance from the center of rotation of the second mounting bracket to said stop means and two lobes whose length is greater than said distance.

25. The apparatus recited in claim 22 wherein said vent means is directed towards said first mounting bracket.

26. The apparatus recited in claim 25 wherein there is a protective shroud over the outlet at said venting means.

27. The apparatus of claim 26 wherein the protective shroud is integral with said conveying means.

28. Material dispensing apparatus for dispensing a solution of said material comprising:

(a) a container of said material formed of a component enabling external observation of a level of said material within said container;

(b) said container having an opening;

(c) conveying means having a first opening and coupling means for coupling said first opening in said conveying means to said opening of said container;

(d) receiving means attached to said conveying means for receiving granules of said material fed from said container, said receiving means comprising a perforated material;

(e) said conveying means connecting said opening of said container to a second opening for dispensing said solution, said conveying means including a substantially cylindrical portion between said first opening and said second opening, dissolving means comprising a nozzle for directing a liquid at said perforated material and the vertical walls of said substantially cylindrical portion; and (f) rotating means for rotating said coupled container and conveying means from a first position wherein granules of said material may be fed from said container to said receiving means, to a second position wherein granules of said material may not be fed from said container to said receiving means.

29. A dispensing apparatus as claimed in claim 28 wherein said material is gravity fed from said container to said receiving means, and said solution is gravity fed from said receiving means to said second opening, said container being operatively disposed when in inverted position above said first opening.

30. The dispensing apparatus recited in claim 29 further comprising discharge means connected to said second opening of said conveying means for discharging said solution.

31. An apparatus for dissolving and dispensing powdered material materials from a container comprising:

(a) a conveying means for said materials having coupling means at one end thereof for coupling to said container;

(b) said conveying means having a first opening at one end for receiving said powdered material from an opening in said container, and a second opening at a second end thereof for dispensing said powdered materials in a dissolved state.

(c) a porous support member within said conveying means for supporting said powdered materials on one surface thereof;

(d) nozzle means disposed within said conveying means for directing a liquid under pressure at another surface of said support member and for wetting powdered material granules supported on said one surface of said support member;

(e) mounting means for rotatably mounting said conveying means to a fixed structure comprising:

(i) first mounting bracket for attachment to a fixed structure;

(ii) second mounting bracket for attachment to said conveying means and for rotatably engaging said first mounting bracket;

(f) said conveying means being rotatable between a first, operative position wherein said powdered materials pass from said container to said porous support member for dissolution and dispensing, and a second, inoperative position wherein said powdered materials do not pass from said container to said porous support member; and (g) a protecting means for said container associated with conveying means.

32. The apparatus as claimed in claim 31 wherein said protecting means comprises a shroud partially covering said container.

33. An apparatus for dissolving dispensing powdered materials from a container comprising:

(a) conveying means for said materials having coupling means at one end thereof for coupling to said container;

(b) said conveying means comprising a funnel member having a first opening coupled to an opening in said container for receiving said powdered materials from said opening in said container, and a second opening at a second end thereof for dispensing said powdered materials in a dissolved state, said funnel having an aperture below said first opening to allow air into said conveying means;

(c) porous structure within said conveying means for supporting powdered materials on one surface thereof;

(d) nozzle means disposed within said conveying means for directing a liquid under pressure at another surface of said support member and for wetting material granules supported on one surface of said support member;

(e) mounting means for rotatably mounting said conveying means to a fixed structure comprising:

(i) first mounting bracket for attachment to said fixed structure;

(ii) second mounting bracket for attachment to said conveying means and for rotatably engaging said first mounting bracket; and (f) said conveying means being rotatable between a first, operative position wherein said powdered materials pass from said container to said conveying means for dissolution and dispensing, and a second, inoperative position wherein said powdered materials do not pass from said container to said conveying means.

34. An apparatus for dissolving and dispensing powdered materials from a container comprising:

(a) conveying means for said material having coupling means at one end thereof for coupling to said container;

(b) said conveying means having a first opening at said one end for receiving said powdered materials from an opening in said container, and a second opening at a second end thereof for dispensing said powdered materials in a dissolved state;

(c) a porous support member within said conveying means for supporting said powdered materials on one surface thereof;

(d) nozzle means disposed within said conveying means for directing a liquid under pressure at another surface of said support member and for wetting said powdered material granules supported on said one surface of said support member;

(e) mounting means for rotatably mounting said conveying means to a fixed support structure comprising:

(i) first mounting bracket for attachment to said first structure;

(ii) second mounting bracket for attachment to said conveying means and for rotatably engaging said first mounting bracket;

(f) said conveying means being rotatable between a first, operative position wherein said powdered materials pass from said container to said conveying means for dissolution and dispensing, and a second, inoperative position wherein said powdered materials do not pass from said container to said conveying means; and (g) control means for enabling and disabling flow of said liquid to said nozzle comprising a solenoid operated valve, and switching means in one of said first and second mounting brackets and actuating means for said switching means in the other of said first and second mounting brackets.

35. The apparatus recited in claim 34 wherein said switching means comprises microswitch means in said first mounting bracket and said actuating means comprises spring actuated means for switching said microswitch means located in said second mounting bracket.

* * * * *